United States Patent [19]

Hayashi

[11] Patent Number: 4,807,339

[45] Date of Patent: Feb. 28, 1989

[54] SUPER HIGH-SPEED APPLICATION ROLLER FOR COATING LOW VISCOSITY LIQUIDS ON A SURFACE OF A FILM

[75] Inventor: Kanji Hayashi, Tokyo, Japan

[73] Assignee: Fanetech Institute Limited, Japan

[21] Appl. No.: 121,535

[22] Filed: Nov. 17, 1987

[30] Foreign Application Priority Data

Nov. 18, 1986 [JP] Japan ..... 61-177915[U]

[51] Int. Cl.[4] ..... B21B 27/00

[52] U.S. Cl. ..... 29/121.5; 29/130; 29/132

[58] Field of Search ..... 29/121.1, 121.5, 130, 29/131, 132; 101/150, 153, 170, 348; 118/DIG. 15

[56] References Cited

U.S. PATENT DOCUMENTS

| | | | |
|---|---|---|---|
| 2,217,552 | 10/1940 | Horton | 118/DIG. 15 X |
| 2,319,615 | 5/1943 | Luehis | 118/DIG. 15 X |
| 2,338,635 | 1/1944 | Galber | 29/121.5 |
| 3,527,668 | 9/1970 | Küsters et al. | 29/121.1 X |
| 4,301,583 | 11/1981 | Poole | 29/121.1 X |
| 4,310,375 | 1/1985 | Seki | 29/121.1 X |
| 4,366,025 | 12/1982 | Gordon, Jr. et al. | 29/121.1 X |
| 4,381,212 | 4/1983 | Roberts | 29/121.5 X |
| 4,458,399 | 7/1984 | Kessler | 101/348 X |
| 4,537,127 | 8/1985 | Fadner et al. | 101/348 X |

*Primary Examiner*—P. W. Echols
*Assistant Examiner*—Irene Cuda
*Attorney, Agent, or Firm*—McGlew and Tuttle

[57] ABSTRACT

An application roller to apply a treated liquid of low viscosity onto the surface of a film or sheet which moves at super high speed includes a radially inner axially extending tubular treated liquid distribution channel for distributing the treated liquid in axial and radial directions, with an outer tubular roller body having an outer surface with circumferentially extending adjacent tops and valleys. The valleys are formed with laterally extending substantially parallel surfaces so that the application roller is of substantially gear shape on its exterior surface and including a lining of an application material over the exterior surface which, at least, cover the tops. The construction also includes a conveyor channel for the treated liquid formed between the treated liquid distributing channel and the application material.

9 Claims, 3 Drawing Sheets

SUPER HIGH-SPEED APPLICATION ROLLER FOR COATING LOW VISCOSITY LIQUIDS ON A SURFACE OF A FILM

BACKGROUND OF THE INVENTION

1. Field of the Invention

This invention relates, in general, to application rollers and, in particular, to a new and useful application roller particularly for super-high speed coating of a sheet material.

As a coating method for treated liquid, such an application roller 23 made of a smooth felt 22 on its surface is known, as shown in FIGS. 6 and 7, wherein a treated liquid distributing pipe 20 extends through the center of the application roller and treated liquid distribution holes 21 are provided in the surface of the distributing pipe 20.

The application roller 23 rotates in contact with the surface of a continuously moving film or sheet, while the treated liquid flows into the felt 22 from the treated liquid distribution holes 21 and oozes out of the surface and is applied to the film or sheet.

This publicly known example is practical in the event that the film or sheet moves at a low speed.

However, it is known that, when the movement speed of this film exceeds 100 m/min., air moves between the surface of the application roller 23 and the film or sheet with subsequent splashing of the treated liquid and subsequent appearance of unevenness to the coated film.

Therefore, in the past, such a work has been performed as forming a coated film on the surface of film or sheet while moving the film or sheet at the speed not to cause any unevenness to the coated film.

As a result, there are some problems as follows in addition to low efficiency.

Usually, either in the case of a magnetic tape or in the case of a packaging film, the formation work of the coated film is performed within the same line. For this reason, since printing speed or bag making speed of a printer is, for example, usually at 100 m/min. or over, these speeds are reduced down to slower than 100 m/min. and therefore the productivity falls if the process for forming the coated film should be incorporated into the line.

Besides the method of forming a coated film on the surface of film or sheet, by atomizing the treated liquid and moving of the film or sheet within the atomized mist, or the method of spraying the treated liquid onto the surface of film or sheet is also publicly known.

However, even in case of these methods, there is a problem that the coated film becomes irregular in thickness if the moving speed becomes higher than 100 m/min.

The invention provides a roller capable of uniformly applying the treated liquid on the surface of film or sheet which moves at a super high speed, e.g. higher than 100 m/min.

In accordance with the invention, an application roller is provided with includes a central axial pipe or tubular member 2 having openings therein with a layer of non-woven cloth over the pipe through which the liquid may penetrate and an outer roller body having an exterior made substantially in a gear shape with circumferentially arranged top portions and valleys which includes an application material engaged over the surface of the gear-shaped exterior which is fed with the liquid which penetrates through the non-woven cloth material and close to a conveyor channel to the exterior of the gear-shaped roller body. In accordance with a feature of the invention, the valleys formed between the projecting gear piece formations permit the escape of any air going over the surface of the roller and move into the valleys during the revolution of the roller at very high speeds. The construction prevents the air from invading the space between the application material and the film or the sheet.

Accordingly, it is an object of the invention to provide an improved application roller which includes a hollow central portion with means for permitting the escape of a treated liquid from the central portion in radial and axial direction and onto the surface of the roller which is of a gear-shaped configuration to penetrate into an application material which is positioned at least at the tops of the gear piece-like formations.

A further object of the invention is to provide an application roller which is simple in design, rugged in construction and economical to manufacture.

The various features of novelty which characterize the invention are pointed with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

GENERAL DESCRIPTION OF THE PREFERRED EMBODIMENTS

Figure 1:
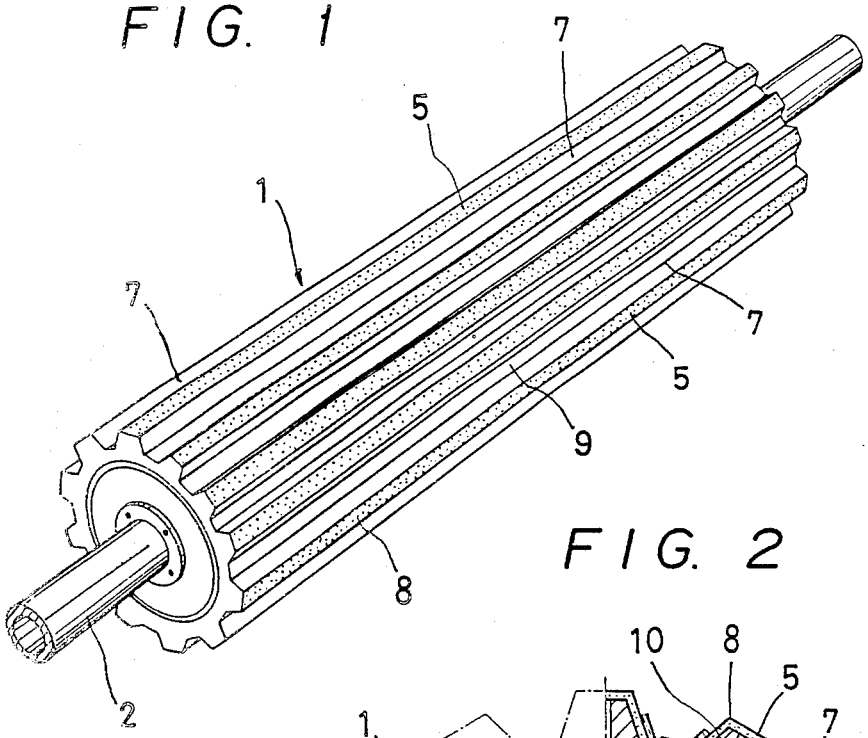
FIG. 1 is a perspective view of an application roller constructed according to the invention.
Figure 2:
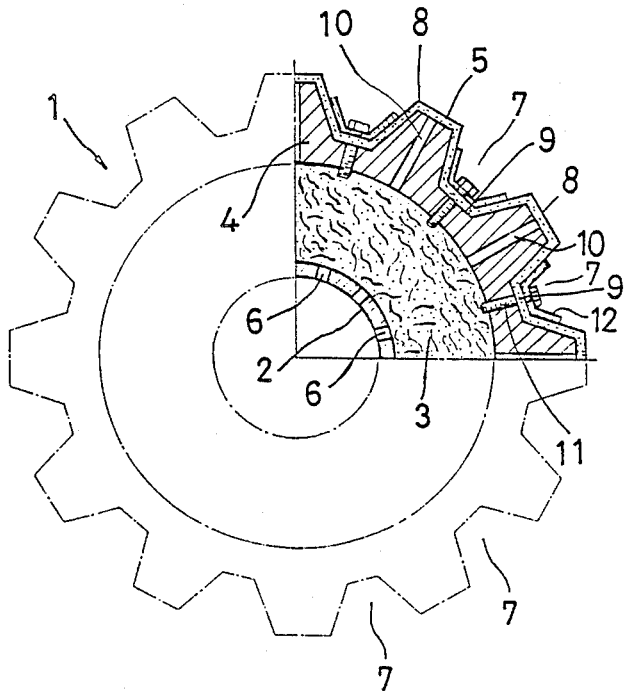
FIG. 2 is a cross sectional view of the application roller of FIG. 1, a part of which is indicated by a dot and dash line.
Figure 6:
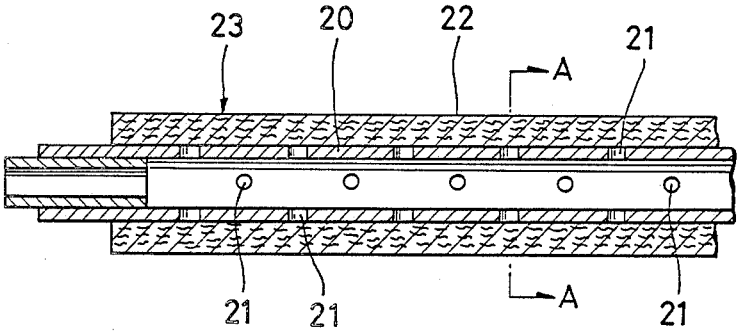
FIG. 6 is a cross sectional view of a known application roller.
Figure 7:
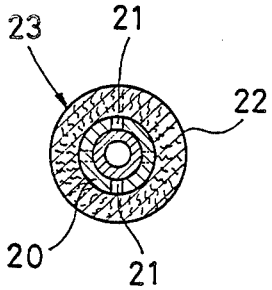
FIG. 7 is a cross-sectional view taken along section line A—A of FIG. 6.

Referring to the drawings, in particular, the invention embodied therein comprises an application roller generally designated 1 which has a central portion formed by an axially extending pipe 2 having a plurality of openings 6 in its outer shell. The pipe 2 permits the inflow of a treated liquid to the roller which also flows radially through the opening 6 and through a material roller portion of non-woven cloth 3. The liquid which penetrates the internal roller portion 3 moves through a channel 10 defined in a roller body or exterior covering 4 which is advantageously made of a metal material or a durable plastic.

In accordance with a feature of the invention, the outer surface of the roller body 4 is formed in the manner of a gear having tops 8 and valleys 9 arranged around in the circumference and with the surfaces of the tops and the valleys being substantially parallel across their lateral width.

An application roller relating to this invention is illustrated in FIG. 1 In the center of the application roller 1, there is an axial pipe 2 which defines a treated liquid distributing channel. On the external side of this axial pipe 2 there is an internal roller 3 made of such non-woven cloth as a felt or made of a continuously foamed substance. The exterior of the internal roller 3 is covered by a roller body 4 made of a hard quality material, for example, metal or plastic. The outer peripheries or tops 8 and valleys 9 are substantially parallel in axial directions and are formed continuously on the surface of the roller body 4. The cross section of the whole application roller 1 is similar to a gear in shape. An application material 5 of a non-woven cloth such as a felt is lined on this surface. The means of applying the lining material 5 is optional, but in this embodiment, the material is fixed in the valley 9 by a tub or lock metal 12 and a bolt 11.

Small holes 6 are provided in a great number on the axial pipe 2, and the treated liquid which has been supplied into the axial pipe 2 overflows in a radial direction by dint of a pressure force of centrifugal force from these holes. The liquid enters into the internal roller 3, oozes out of it, passes through the treated liquid channel 10 on the roller body 4 and reaches the application material 5.

A groove 7 for preventing air from interacting with the liquid utilizes the valley 9 formed on the external surface of roller body 4.

Figure 5:
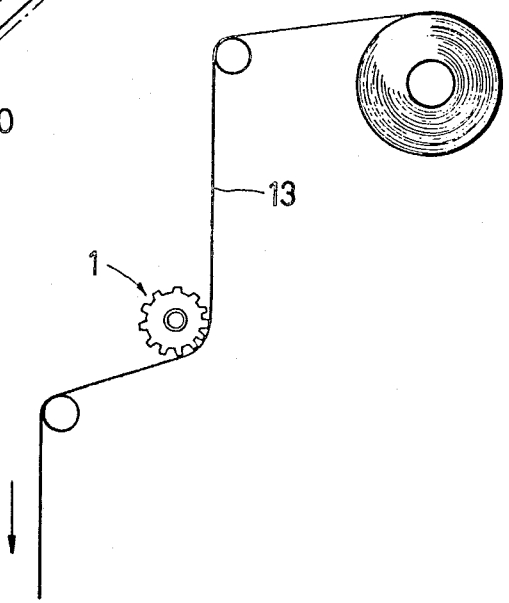
FIG. 5 is an explanatory view in the state where a treated liquid is being coated onto the surface of the film by use of the application roller according to this invention.

The application roller 1 having the aforesaid structure is arranged in contact with the film or sheet 13 moving at a super high speed as illustrated in FIG. 5, and its peripheral speed is either set to a lower speed than the movement of film or sheet 13, or the application roller is rotated in an opposite direction to that of film or sheet 13.

The treated liquid is forced by pressure into the axial pipe 2 from a treated liquid supplying unit (not shown in the figure). The pump or pressurizing means may comprise either a pump pressure or head pressure. The pressed-in treated liquid overflows to the side of internal roller 3 from small holes in axial pipe 2. As the internal roller 3 is an impregnated body made of a felt and the like, the overflowing treated liquid becomes impregnated into the entirety of internal roller 3. The impregnated treated liquid enters into the treated liquid channel 10 on roller body 4 by the action of centrifugal force and soaks into the application material 5 on the surface via this channel 10. The treated liquid which is impregnated in this way expands to the entirety of application material 5, especially to the top or peripheral area 8, and is applied to the film or sheet getting in contact with this surface. And as the peripheral speed of application roller 1 is slower than the movement speed of film or sheet 13, the liquid is uniformly distributed on account of the advent of a sliding action between both the members. Or the liquid is uniformly dispersed between the application roller 1 which rotates in an opposite direction thereby causing a sliding action against the film or sheet 13.

The air which moves between the film or sheet 13 and the application roller 1, is shielded by the top 8 of an air flow preventing groove 7, and the shielded air enters into the air flow prevention groove 7 to escape therefrom, and hence is prevented from being involved between the film or sheet 13 and the application roller 1.

Figure 3:
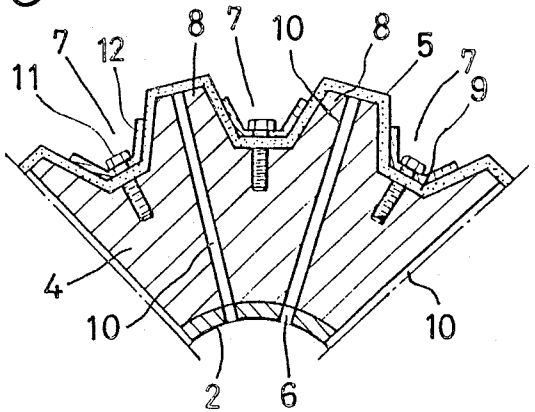
FIG. 3 is a partial cross sectional view of the application roller in the state where the application cloth on the application roller surface has been lined on the entire surface of application roller.

For reference, in the aforesaid embodiment, the internal roller 3 and the roller body 4 may be in the form of a solid body utilizing a sintered metal as shown in FIG. 3, and if the roller body 4 is made of a sintered metal, the treated liquid channel 10 is not necessary. However, in such an embodiment, there may be a need for preventing the treated liquid from overflowing uselessly by a centrifugal force also from the surface of air prevention groove 7. This can be determined by the density of sintered metal and the viscosity and centrifugal force of treated liquid.

Figure 4:
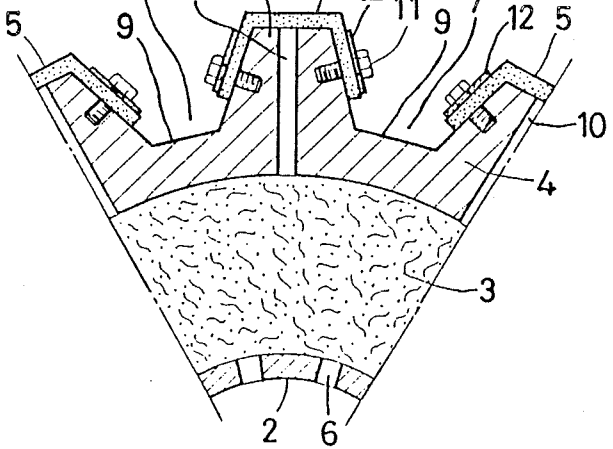
FIG. 4 is a partial cross sectional view of the application roller in the state where the application material of application roller surface has been lined only on the hill side.

Secondly, the application material 5 may be structured only on the outer surface portion of the top 8 in the roller body 4 as shown in FIG. 4.

The internal roller 3 has a function of regulating the liquid volume in the event that the rotary speed of application roller 1 is high and a centrifugal force considerably acts on the treated liquid. For this reason, the material and thickness of this roller 3 needs to be investigated in consideration of the treatment conditions.

Since this invention builds up the surface of application roller to a gear shape in its cross section and forms the air involving prevention groove here, the air inflowing along the film or sheet surface is compelled to escape into the air involving prevention groove. As a result, there is an effect capable of forming the coated film of a desired thickness uniformly at a super high speed without splashing the applied liquid because the air is hardly involved between the film or sheet and the roller.

While specific embodiments of the invention have been shown and described in detail to illustrate the application of the principals of the invention, it will be understood that the invention may be embodied otherwise without departing from such principals.

What is claimed is:

1. An application roller to apply a treated liquid of low viscosity onto the surface of the sheet moving at high speed, comprising a radially inner axially extending tubular treated liquid distribution channel for distributing the treated liquid in axial and radial directions, an outer tubular roller body mounted over said treated liquid distribution channel and having an outer surface with circumferentially extending adjacent heel-like projections forming tops and valleys between said tops extending around the circumference of said roller body, and an application material extending over the surface of said tubular roller body at least on said tops, and means defining a conveyor channel for the treated liquid to be conveyed between said treated liquid distribution channel interior and said application material.

2. An application roller, according to claim 1, wherein the entire exterior surface of said application roller is covered with an application material.

3. An application roller, according to claim 1, wherein said treated liquid distribution channel comprises a pipe having walls with perforations and including an internal roller of a material forming a liquid-penetratable mat disposed between said treated liquid distribution channel and said roller body.

4. An application roller, according to claim 3, wherein said roller body is made of at least one of a metal and a plastic, said internal roller being made of at least one of a non-woven cloth and a continuously formed substance and wherein said application material is felt.

5. An application roller, according to claim 1, wherein said mounting of said roller body comprises an internal roller formation of liquid penetratable material, said internal roller and said roller body being made of a sintered metal.

6. An application roller, according to claim 1, wherein said means for mounting said plastic roller body includes an internal roller made of sintered metal and including a lock metal piece arranged over said application material at least in said valleys and a bolt extending through said lock metal piece.

7. An application roller, according to claim 1, wherein said application material extends over just said tops and the sides of said tops.

8. An application roller, according to claim 1, wherein said application material extends completely over the surface of said roller and including a lock metal piece overlying said material and a bolt threaded into said lock metal piece and said material to said roller body.

9. An application roller construction comprising a central hollow tubular pipe having a circumference with openings therethrough for the passage of a liquid to said opening, an internal roller formation of matted material permitting the passage of the liquid therethrough over said axial pipe, and an exterior roller body construction overlying said internal roller and having an outer surface of gear-shaped formation, at least some of said gear formations having a channel therethrough for the passage of liquid from said internal roller outwardly and including an application material overlying the surface of said roller body.

* * * * *